United States Patent [19]

Kunimoto et al.

[11] 4,270,665

[45] Jun. 2, 1981

[54] PEELABLE ADHESIVE STRUCTURE AND METHOD FOR ITS MANUFACTURE

[75] Inventors: Go Kunimoto; Fumio Mori, both of Yokahama, Japan

[73] Assignee: Toyo Seikan Kaisha, Ltd., Tokyo, Japan

[21] Appl. No.: 50,864

[22] Filed: Jun. 22, 1979

[51] Int. Cl.[3] ..... B65D 41/12; B32B 15/08

[52] U.S. Cl. ..... 215/347; 40/311; 260/DIG. 37; 428/202; 428/204; 428/209; 428/414; 428/416; 428/418; 428/460; 428/461; 428/216; 428/218; 428/463; 428/466; 428/467; 428/458; 428/522; 428/502

[58] Field of Search ..... 260/DIG. 37; 428/463, 428/202, 204, 209, 414, 416, 418, 522, 216, 218, 461, 458, 466, 467, 502, 460; 215/230, 328, 347, 341, 343, DIG. 2, DIG. 4; 40/311, 307

[56] References Cited

U.S. PATENT DOCUMENTS

| | | | |
|---|---|---|---|
| 3,171,560 | 3/1965 | Desch | 260/DIG. 37 |
| 3,233,770 | 2/1966 | Water | 215/230 |
| 3,257,021 | 6/1966 | Brokett | 260/DIG. 37 |
| 3,330,720 | 7/1967 | Stevens | 260/DIG. 37 |
| 3,344,093 | 9/1967 | Strickman | 260/DIG. 37 |
| 3,361,281 | 1/1968 | Kehe | 215/228 |
| 3,406,854 | 10/1968 | Testa | 260/DIG. 37 |
| 3,487,124 | 12/1969 | Yeshin | 428/461 |
| 3,557,030 | 1/1971 | Simons | 260/DIG. 37 |
| 3,581,690 | 6/1971 | Zapata | 113/121 A |
| 3,607,362 | 9/1971 | Cormack, Jr. | 280/DIG. 37 |
| 3,633,781 | 1/1972 | Zapata | 215/230 |
| 4,012,270 | 3/1977 | Fitko | 428/416 |
| 4,034,132 | 7/1977 | Manuel | 428/416 |
| 4,062,997 | 12/1977 | Hotta | 428/416 |

*Primary Examiner*—Ellis P. Robinson
*Attorney, Agent, or Firm*—Pennie & Edmonds

[57] ABSTRACT

A peelable adhesive structure comprises a plurality of articles, including at least one metal article, bonded together through a composite coating layer. The composite coating layer comprises adjacent first and second coating layers, the first coating layer containing vinyl resin, and the second coating layer containing epoxy resin. At least one of the coating layers comprises:

(a) a peeling imparter at a concentration of between about 50 and 200 parts by weight per 100 parts of resin, and (b) a substantially linear saturated polyester wetting improver at a concentration of between about 2 and 50 parts per 100 parts of resin and having a molecular weight of between about 5,000 and about 50,000.

Alternatively, at least one of the coating layers comprises a hydrocarbon or natural resin having a softening point less than 180° C. and having a concentration between about 50 and 200 parts per 100 parts of resin. The vinyl resin or the epoxy resin is in the form of a continuous phase, and the hydrocarbon or natural resin is in the form of a dispersed phase.

The adhesive structure has a peel strength of from 0.05 to about 5 kg/cm between the first and the second coating layers.

25 Claims, 4 Drawing Figures

PEELABLE ADHESIVE STRUCTURE AND METHOD FOR ITS MANUFACTURE

DESCRIPTION

1. Technical Field

The invention relates to a peelable adhesive structure. Specifically, it relates to an adhesive structure having a plurality of articles, one of which is metal, bonded together through a composite coating layer. These plural articles can be peeled at the interfaces of the plural types of coated layers.

Such adhesive structures, where a plurality of articles are mutually sealed but can be peeled, have been utilized in various technical fields, particularly in the packaging field for containers, container covers and sealing materials.

2. Background Art

There is widespread use of products utilized as sealing materials for crowns and other container covers. Those products are typically constructed from sheet metal painted with a surface protective paint and formed into shapes such as crown seals or cap seals. The shaped products have packing adhered to their inner surfaces. For marketing of bottled beverages having packing used in contests, lotteries, sweepstakes and the like, a typical marketing technique requires the purchaser of the bottled beverage to return a prescribed number of packings or return a packing containing a winning ticket to a designated organization to receive some kind of prize. In the manufacture of crowns and caps used in such marketing techniques, the packing must easily peel from the crown seal or cap. During manufacture of the crowns and caps, during transport and during capping of the container, it is essential that the packing adhere to the crown or cap seals. It is also essential for the crown or cap seals to have sufficient corrosion resistance against the contents of the container, some of which have a strong tendency to corrode, and be able to withstand mechanical processes like crimping and roll on. Further, printing on packing surfaces cannot directly contact the contents of the container because such contact is unsanitary. Also, because the packing is ordinarily applied to inner surfaces of crown seals or caps in a fluid condition, it is advantageous that the ink layer applied on inner surfaces of crown seals or packs transfer so that the ink layer adheres to the packing when it is peeled.

Adhesive constructions requiring this type of peelability are also required for cans furnished with opening mechanisms like a "pop-top" or easy-open construction. Exemplary of such constructions are those having one or more openings used to drink the contents of the can. The openings are provided in a can end element which include a metal element coated with a surface protective paint, and pieces used for peeling are adhered thereto. Those pieces comprise an organic resin coated metal foil or sheet which covers the opening. This easy-open end requires improved fastenability and sealability between the can end element and the peeling piece to preserve the contents of the can. Also, the peeling piece must be easily released from the can end element without damaging it when the can is opened.

The present invention provides a peelable adhesive structure useful in marketing techniques. The structure is corrosion resistant, sanitary and possesses sufficient structural integrity to withstand mechanical processes like crimping. The structure provides improved fastenability and sealability sufficient to preserve the contents of a container, yet this structure permits easy access to the container.

Disclosure of Invention

In accordance with the present invention, an adhesive construction is provided including a plurality of articles comprising at least one metal article, adhered by plural types of coated layers. The plural articles can be peeled between the plural types of coated layers. The present invention also provides an adhesive construction in which the plurality of articles are adhered by means of these coated layers so that they have a peeling strength between about 0.05 and 5 kg/cm between a first and second coating layer.

The present invention further provides a container cover in which packing, particularly packing comprising polyolefin, is peelably adhered to a crown seal, cap or other container cover made from a metal base and plural types of coating layers.

An easy-open end is provided which peelably adheres, through the use of plural types of coating layers, the peeling piece to the can end element that includes the opening.

Generally, the present invention is directed to a peelable adhesive structure comprising a plurality of articles, which includes at least one metal article, bonded together through a composite coating layer, the composite coating layer comprising adjacent first and second coating layers, the first coating layer containing vinyl resin, the second coating layer containing epoxy resin. At least one of the coating layers comprises:

(a) a peeling imparter at a concentration of between about 50 and 200 parts by weight per 100 parts by weight of resin, and (b) a saturated polyester wetting improver at a concentration of between about 2 and 50 parts by weight per 100 parts by weight of resin.

The plurality of articles have a peeling strength between about 0.05 and 5 kg/cm between the first and the second coating layers.

Generally, another embodiment of the present invention is directed to a peelable adhesive structure comprising a plurality of articles, which includes at least one metal article, bonded together through a composite coating layer, the composite coating layer comprising adjacent first and second coating layers, the first coating layer containing vinyl resin, the second coating layer containing epoxy resin. At least one of the coating layers comprises:

a hydrocarbon or natural resin having a softening point less than 180° C. and having a concentration between about 50 and 200 parts by weight per 100 parts by weight of resin.

The vinyl resin or the epoxy resin is in the form of a continuous phase. The hydrocarbon or natural resin is in the form of a dispersed phase. The plurality of articles has a peeling strength between about 0.05 and 5 kg/cm between the first and second coating layers.

Broadly, the present invention is also directed to a method of manufacturing a peelable adhesive structure comprising:

(a) preparing a first paint solution containing vinyl resin and a hydrocarbon or natural resin having a softening point less than 180° C. and having a concentration between about 50 and 200 parts by weight per 100 parts by weight of vinyl resin wherein the hydrocarbon or natural resin is stably emulsified and dispersed in a continuous phase of the vinyl resin, (b) applying the first paint solution onto a metal base material to form a first coating layer, (c) forming a second layer by applying a second paint solution containing epoxy resin and polyethylene oxide at a concentration of between about 0.5 and 90 weight percent of the epoxy resin over the first coating layer, and (d) joining a layer of olefin resin to the second coating layer by melt adhesion or heat sealing.

BRIEF DESCRIPTION OF DRAWINGS

Features of the present invention will be described in connection with the accompanying drawings in which.

BEST MODE FOR CARRYING OUT THE INVENTION

Figure 1:
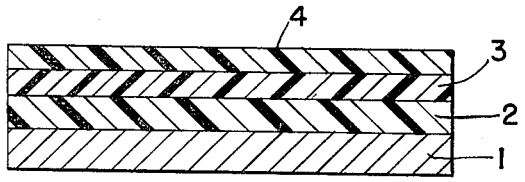
FIG. 1 is a cross-sectional view of the peelable adhesive structure of the present invention.

Referring to the drawings, FIG. 1 shows in cross-section the subject peelable adhesive structure. A surface or substrate 1 comprising a metal base material is shown adhered or bonded to a composite coating layer comprising a first coating layer 2 containing a vinyl resin, onto which is applied a second coating layer 3 containing an epoxy resin. A metal or plastic article 4 is adhered on top of coating layer 3 by means of composite coating layers 2 and 3.

An important characteristic feature of the present adhesive structure is the discovery that when the first coating layer 2 is constructed from vinyl resin and the second coating layer 3 is constructed from epoxy resin, and when a peeling imparter and a saturated polyester wetting improver are contained in at least one of these two coating layers, the adhesive structure will have a peeling strength of between about 0.05 and 5 kg/cm, preferably between about 0.4 and 1.5 kg/cm, between the first coating layer 2 and the second coating layer 3. Such a peeling strength prevents peeling during ordinary handling as well as under substantial impacts, but when required, peeling can be easily accomplished without using special implements.

Another feature of the present invention is the discovery that when the first coating layer 2 is constructed from vinyl resin and the second coating layer 3 is constructed from epoxy resin, and at least one of these coatings contains hydrocarbon or natural resins which are present in the form of a dispersed phase, the adhesive structure will have a peeling strength of between about 0.05 and 5 kg/cm, preferably between about 0.4 and 1.5 kg/cm, between the first coating layer 2 and the second coating layer 3. As mentioned above, such peeling strengths prevent peeling during ordinary handling and during substantial impacts, yet peeling can be easily accomplished.

The fact that the first coating layer 2 is vinyl resin and the second coating layer 3 is epoxy resin is fundamental to the present invention because it increases the adhesiveness of the coatings toward adhered parts 1 and 4 and also adjusts the peeling strength of these two coating interfaces to the range described above. Because either layer can contain the peeling imparter so that suitable peeling can be imparted to the coating interface of both layers and because either layer can contain the saturated polyester wetting improver, in relation to the use of the peeling imparter, it is possible to apply the second coating layer on the first coating layer. Additionally, because either layer can contain a hydrocarbon or natural resin in the form of a dispersed phase, that is, in an ocean-island relationship, it is again possible to paint the second coating layer onto the first coating layer while imparting suitable peelability to the coating interface between them. These are very important discoveries.

Vinyl Resin

The vinyl resin used to form the first coating layer is preferably a copolymer of (a) vinyl chloride, and (b) at least one other ethylenically unsaturated or vinyl monomer such as vinyl acetate, vinyl alcohol, vinyl acetal, acrylic acid, methacrylic acid, maleic acid, furaric acid, itaconic acid, alkyl acrylate ester, alkyl methacrylate ester and vinylidene chloride. While the composition of the vinyl chloride (a) with another vinyl monomer (b) can be formulated in various concentrations, ordinarily the mole ratio of a:b is between about 95:5 and 60:40, preferably between about 90:10 and 70:30. The molecular weight of the vinyl resin should ordinarily be in the molecular weight range capable of forming film.

Examples of suitable vinyl resins are vinyl chloride-vinyl acetate copolymer, vinyl chloride-vinyl acetate copolymer partially acetalated and/or partially saponified, vinyl chloride-vinyl acetate-maleic-anhydride copolymer and vinyl chloride-vinylidene chloride-acrylic acid copolymer.

These vinyl resins can be used alone or in combination with other resin modifiers. Examples of suitable resin modifiers are amino resins such as resol type phenol resin, xylene-formaldehyde resin, urea resin and melamine resin, and heat curing resins such as epoxy resin.

The vinyl resin paint used in the present invention displays especially superior adhesiveness on articles made from a metal base. Metal bases coated with this paint have excellent processing and corrosion resistance characteristics. For optimum properties, vinyl resin (A) and at least one resin modifier selected from phenol resin, amino resin and epoxy resin (B) should be formulated in concentrations where the mole ratio A:B is between about 60:40 and 98:2, preferably between about 70:30 and 90:10.

In addition to the vinyl chloride resins described above, other vinyl resins can be used which are well known in the art for the vinyl resin of the present invention, for example, those vinyl resins used in the paint industry.

Epoxy Resin

The epoxy resin may be a high molecular weight compound containing two or more epoxy groups in its molecular structure and combinations with substances reactive with starting groups or hardener compounds having low to high molecular weights which are reactive to epoxy groups.

Ordinarily, epoxy resins obtained by condensation of epichlorhydrin and polyhydric phenols are suitable. Such epoxy resins have a molecular structure shown by the following formula:

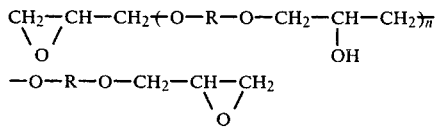

(I)

where n is zero or an integer, particularly an integer of at least about 12. Polycyclic phenols, such as 2,2-bis(4-hydroxyphenyl)propane (bisphenol A); 2,2-bis(4-hydroxyphenyl) butane (bisphenol B); 1,1'-bis(4-hydroxyphenyl)-ethane, and bis(4-hydroxyphenyl)methane (bisphenol F), are suitable for use as the dihydric phenol (HO-R-OH). Bisphenol A is preferred. Precondensates (resols) of phenols and formaldehyde like polycyclic phenols can also be used. Preferably, the epoxy resin, used as a resin ingredient, should have an epoxy equivalent of about 140 to about 4,000, and preferably in the range of about 200 to about 2,500.

Hardener compounds that may be used in combination with these epoxy resin ingredients are multifunctional compounds reactive to epoxy groups, for example, polybasic acids, acid anhydrides, polyamines and polyamides. Other suitable hardener compounds are ethylene diamine, diethylene triamine, triethylene tetramine, metaphenylene diamine, 4,4'-diamino-diphenylmethane, 4,4'-diamino-diphenylsulfolane, 4,4'-diamino-diphenyl ether, dimer acid polyamide, adipic acid hydrazide, oxalic acid, anhydride phthalic acid, anhydride maleic acid, hexahydrophthalic acid anhydride, pyromellitic acid dianhydride, cyclopentadiene-methyl maleic acid addition product, dodecyl succinic acid anhydride, dichlormaleic acid anhydride and chlorendic acid anhydride.

The concentration of the hardener should be between about 2 and 150 parts by weight per 100 parts by weight of the epoxy resin component, and preferably between about 20 and 60 parts by weight. Unless otherwise specified, concentration will be expressed in parts by weight.

The epoxy resin component (C) is used as the second coating layer in the composite with at least one heat curing resin selected from a resol type phenol-formaldehyde resin, urea-formaldehyde resin and melamine-formaldehyde resin (D). Although the concentration ratios of the two resins can vary over a wide range, the resins should be formulated in concentrations such that C:D is between about 5:95 and 95:5 and preferably between about 40:60 and 90:10 by weight. The epoxy resin ingredient (C) and the heat curing resin (D) can be used in the mixed state to form the second coating layer or they can be used in the precondensed state to form that layer. Coatings comprising this combination have particularly superior adhesive and process characteristics to metal or plastics.

The resin composition of the second coating can by further modified with vinyl resin. The above-described substances can be widely used as the vinyl resin. They should be used in concentrations of between about 20 and 400 parts per 100 parts of epoxy resin ingredient (A) and preferably between about 100 and 300 parts.

Peeling Imparter

The peeling imparter or resin contained in at least one of the coating layers is a hydrocarbon or natural resin whose softening point, measured by the ring and ball method, is less than about 180° C. and preferably less than about 120° C. Suitable peeling imparters are petroleum resins, cumarone-indene resins, terpene resins, rosins and rosin esters.

Known petroleum resins have petroleum saturated hydrocarbons as their main feedstocks, like cyclopentadiene or higher olefin hydrocarbons, which typically have from about 9 to 11 carbon atoms. The resins are obtained by heat polymerization with a catalyst. Any of these resins can be suitably used as peeling imparters. Known cumaroneindene resins are substances having a comparatively low degree of polymerization that are polymerized under heat and with a catalyst using feedstocks comprising tar fractions whose main ingredients are cumarone and indene. Their softening point is between 160° and 180° C. These resins can also be used in the present invention. Useful terpene resins are synthetic or natural polymers of terpene hydrocarbons. These resins are obtained by polymerizing terpene oil or nopinene fractions with a catalyst. It is also possible to use so-called raw rosins, such as gum rosin and wood rosin, as well as diesters obtained by esterification of abietic acid in rosins, for example rosin glycerine ester (ester gum), diethylene glycol abietate, 2-hydrodiethylene glycol abietate, rosin monoethylene glycol ester, and rosin pentaerythritol ester.

Other hydrocarbon polymers can also be used, alone or in combinations, with the peeling imparters, in the present invention as long as they have a comparatively low degree of polymerization and have softening points within the range described above. Low molecular weight polyethylene (polyethylene wax), polypropylene, polystyrene and hydrogen addition polystyrene can be such polymers.

Polyester Wetting Improver

As saturated polyester wetting improvers, effective use can be made of: (I) combinations of at least one type of dibasic acid and at least two types of diols, or (II) combinations of at least two types of dibasic acids and at least one type of diol, that have been condensed to give a substantially linear saturated polyester. In these copolyesters, different ester repeat positions may be randomly connected or regularly connected.

The dibasic acid ingredients in these copolyesters may be dibasic acids described by the formula:

$$HOOC—R^1COOH \quad (II)$$

where $R^1$ is a dibasic hydrocarbon group free of ethylenic unsaturation and having from about 2 to about 15 carbon atoms, and preferably from 6 to 10 carbon atoms. Suitable acids are aromatic dibasic acids like terephthalic acid, isophthalic acid, 2,5-dichlorterephthalic acid, naphthalene-1,5-dicarboxylic acid, diphenyl-4,4'-dicarboxylic acid, and diphenylmethane-4,4'-dicarboxylic acid, aliphatic dibasic acids, such as succinic acid, adipic acid, suberic acid, azelaic acid, sebacic acid, decanedicarboxylic acid and dodecanedicarboxylic acid, or 1,4-cyclohexanedicarboxylic acid.

The diol ingredients may be the diols described by the formula:

$$HO—(—R^2—O—)_n—H \quad (III)$$

where $R^2$ is an aliphatic, alicyclic or aromatic-aliphatic dibasic hydrocarbon base, and n is an integer equal to or greater than 1. Suitable diols are 1,2-ethanediol, 1,3-propanediol, 1,5-pentanediol, 2,3-butanediol, 1,3-butanediol, 1,2,-propanediol, 2,4-dimethyl-2-ethylhexane-1,3-diol, neopentyl glycol, 2-ethyl-2-butyl-1,3-propanediol, 1,6-hexanediol, diethylene glycol, triethylene glycol, dipropylene glycol, 1,4-cyclohexanediol, o-, m- and p-xylylene glycol, and hexahydro-p-xylylene glycol.

Regarding the saturated polyester wetting improvers used in the present invention, it is important that aromatic dibasic acids comprise at least about 50 mole percent of the dibasic acid, and preferably about at least 70 mole percent to obtain desired mechanical properties and corrosion resistance of the coating. Aliphatic dibasic acid and alicyclic dibasic acids can be used as long as these concentration limits are not exceeded. Similarly, the diol ingredients should comprise at least about 60 mole percent and preferably at least about 80 mole percent, alkylene glycols having about 2 to 4 carbon atoms, such as 1,2-ethanediol or 1,4-butanediol. It is possible to use xylylene glycol, alicyclic glycols and poly(di, tri, and the like) alkylene glycols within these concentration limits.

Polyester wetting improvers suitable for use in the present invention may contain combinations of terephthalic acid (T) and isophthalic acid (I) as the dibasic acid ingredient, or combinations of ethylene glycol (E) and 1,4-butanediol (B) as the diol ingredient. The mole ratio of the terephthalic acid (T) and isophthalic acid (I) can vary over a broad range. Typical, suitable mole ratios of (T):(I) are between about 90:10 and 10:90, and preferably between about 70:30 and 30:70. Also, suitable mole ratios for ethylene glycol (E) and 1,4-butanediol (B), (E):(B), are between about 90:10 and 10:90 and preferably between about 60:40 and 40:60.

A polyester wetting improver especially useful in the present invention is a linear saturated polyester containing terephthalic acid and isophthalic acid in the mole ratios for the dibasic acid ingredient, and ethylene glycol and 1,4-butanediol in the mole ratios for the diol ingredient. Another type of polyester wetting improver especially useful in the present invention is a linear saturated polyester that contains, in addition to the aromatic dibasic acid ingredient, an internal plasticizing dibasic ingredient such as a fatty acid dibasic acid present at between about 1 and 100 moles per 100 moles of the aromatic acid ingredient and preferably between about 5 and 30 moles. This dibasic ingredient has about 6 to 14 carbon atoms, for example, adipic acid, sebacic acid and dodecanedicarboxylic acid. Linear aromatic polyesters described in the following formula are particularly suitable:

$$-(-T\cdot E-)-(-T\cdot B-)-(-I\cdot E-)-(-I\cdot B-)-(-S\cdot E-)-(-S\cdot B-)-$$

where T is a terephthalic acid unit, I is an isophthalic acid unit, S is a sebacic acid unit, E is an ethylene glycol unit and B is a 1,4-butanediol unit. These units are selected so that their weights satisfy the conditions noted above.

The polyester wetting improvers of the present invention can be made by conventional methods, except that they must satisfy the above requirements. These polyester wetting improvers may have molecular weights capable of forming film, that is, molecular weights of about 5,000 to about 50,000 and preferably about 10,000 to about 30,000.

In the subject invention, it is particularly important that the linear saturated polyester is used as the wetting improver. Specifically when the epoxy resin paint is furnished directly on the coating of vinyl resin that contains the peeling imparter, the epoxy resin paint will be repelled from the vinyl resin coating; and it will be difficult to form a uniform and even coating. Similarly, this tendency is found when resins other than linear saturated polyesters are contained in the epoxy resin coating, for example, polyamide, alkyd resin and unsaturated polyester. Surprisingly, when the polyester wetting improver is contained in the epoxy resin paint or vinyl resin paint, there will be an unexpected improvement in the wetting properties at the interface between the two resin paints. Thus, it is possible to form uniform and even coatings.

Blending

In the present invention, the peeling imparters alone or in combination with the polyester wetting improvers are contained in one or both of the first or second coating layers.

It is also important that the peeling imparters be blended in amounts between about 50 and 200 parts, preferably, between about 100 and 200 parts, per 100 parts of vinyl chloride resin or epoxy resin. When lower concentrations are used, there is no peeling effect between the two coating layers. When high concentrations are used, defects, such as uneven coating and orange-peel texture occurs, which makes manufacture of the present adhesive structure difficult. Also, when these concentration ranges are exceeded, the processability of the metal bases on which the coatings are applied becomes poor, the coatings become brittle, dust increases, and cracking occurs.

It is also important that the polyester wetting improver be blended in amounts of between about 2 and 50 parts per 100 parts of vinyl chloride resin and preferably between about 10 and 30 parts. When lower concentrations are used, there is no wetting improvement effect between the two coating layers, and the defects described above will also occur. When used in concentrations greater than those indicated above, depending on the types of resin in the combination, the mutual solubility of the resins decreases or the solution becomes impossible leading to poor properties in the coating. Even if the resins are mutually soluble, the adhesive strength of the two resin layers will be too great so that peeling is difficult.

In the present invention, it is preferred that the blend amounts be set so that the peeling strength between the two coating layers is 0.4 to 1.5 kg/cm. Most favorable results are achieved when the amounts are set so that the peeling imparter is about 150 parts and the polyester wetting improver is about 20 parts.

In the present invention, is is particularly desirable that the vinyl resin paint contain a peeling imparter like petroleum resins or a combination of the peeling imparter and unsaturated polyester wetting improver. This enhances mutual solubility between resins, wetting improvement effects and peeling improvement effects.

Adhesive Structure

The adhesive structure of the present invention can have any desired arrangement and combination as long as it comprises multilayer coating composite having a plurality of articles containing the described adjacent first and second coating layers.

It is generally preferable that the article to which the first and second coatings are applied be a metal base material. That material may be foil or sheet surface untreated steel (black plate), a light metal such as aluminum, or surface treated steel or aluminum. Suitable surface treated steels are steels in foil or sheet form whose surfaces have undergone chemical treatments such as phosphoric acid treatment, chromic acid treatment, and phosphoric acid-chromic acid treatment, electrolytic treatments such as electrolytic chromic acid treatment and electric tin plating treatment, or melt plating treatments such as hot dip tin plating treatment. Exemplary surface treated aluminums are aluminums in foil or sheet form that have undergone treatments like anodic oxidation treatment and chromic acid treatment. Articles comprising these metals can be containers such as crown seals or cap seals, can covers or metal containers that are seamless or which are furnished with side seams.

These metal materials should be treated with a protective coating layer other than the first coating layer to stop corrosion, for example an epoxy-phenol paint or an epoxy-amino resin paint. Of course, this protective coating must form a firm adhesion, whose peeling strength is greater than the peeling strength of the first coating layer and the second coating layer, between the metal base material and the first coating layer.

The second article which is adhered to the first article by means of the first and second coating layers can be a film, sheet or other formed products made from various plastics or rubber, or various kinds of paper or composite products, to which the metal base substance has been added. For example, plastics that can be used are polyolefins such as low, medium or high density polyethylene, polypropylene, polypentene-1, poly-4-methylpentene-1, ethylene-propylene copolymer ethylene-vinyl acetate copolymer and ionomer, various types of polyamides such as nylon-6, nylon-6,6, nylon-6,10 and nylon-12, polyesters such as polyethyleneterephthalate and polybutyleneterephthalate, polycarbonates, acrylonitrile copolymer such as high nitrile resin and other acrylic resins. Film made from these plastics may be unstretched or stretched biaxially. Suitable synthetic rubbers are styrene-butadiene rubber, nitrile-butadiene rubber, ethylene-propylene rubber, ehtylene-propylenediene rubber, butyl rubber, stereo rubber and polyisobutylene rubber. It is also possible to use blends of at least one of the plastics with at least one of the synthetic rubbers. The plastic materials can also be surface treated by corona discharge treatment or ozone treatment in order to increase their adhesiveness on the coatings. The articles can be used in the subject adhesive structure as formed products such as packings.

The second article can comprise a composite utilizing the various types of materials described above. For example, the second article can be a laminate of metal foil such as aluminum, provided with a film of polyolefin on one surface as a heat sealing layer and with paper or film having a higher melting point than the polyolefin film on the other surface.

Any known protective coating layer or undercoating layer can be applied between the second article and the second coating layer. Of course, such protective coating layers must adhere with a peeling strength between the second article and the first coating layer greater than the peeling strength between the first coating layer and the second coating layer.

Consequently, the coating layers of the adhesive structure are not restricted to a particular number of coating layers, as long as the first coating layer and second coating layer are adjacent. Although ordinarily unnecessary, multilayer constructions having three, four or more layers are within the purview of this invention.

Figure 2:
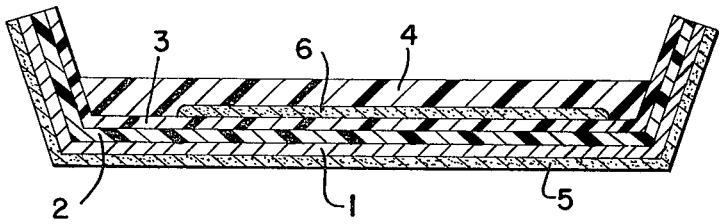
FIG. 2 is another cross-sectional view of a crown or cap with the present peelable structure.

FIG. 2 shows an adhesive structure in the form of a crown or cap. A conventional protective paint layer 5 is applied to the outside surface of crown or cap seal 1. The seal 1 comprises a metal material such as aluminum tin-plated steel sheet or tin-free steel (electrolytic chromic acid treated steel sheet), a first coating layer 2, containing vinyl resin, applied to the inside surface of seal 1, and a second coating layer 3 containing epoxy resin applied to first coating layer 2. Of course, a peeling imparter and a saturated polyester wetting improver are included in at least one of coating layers 2 and 3. A printing ink layer 6, which may indicate an advertisement, is provided on top of second coating layer 3. Then, a packing 4 comprising polyolefin or synthetic rubber is applied on top of second coating layer 3 and printing ink layer 6. Packing 4 is supplied to the inside of the crown or cap in a molten or semimolten state and formed in the shape of the packing by compression under cooling with a suitable stamping element (not shown). The packing 4 will adhere to second coating layer 3 and printing ink layer 6.

In this crown or cap seal, first coating layer 2 is firmly joined to cap seal 1 at a peeling strength generally of at least 2 kg/cm. Second coating layer 3 and printing ink layer 6 are firmly joined to packing 4 at a peeling strength generally of at least 0.2 kg/cm. First coated layer 2 and second coated layer 3 are adhered at a peeling strength of between about 0.05 and 5 kg/cm, so that packing 4 can be easily peeled from seal 1 between first coating 2 and second coating 3.

If necessary, ink layer 6 can be printed on first coated layer 2 in the crown or cap. Specifically, printing ink layer 6 can be present at the interface between first coating layer 2 and second coating layer 3.

Another or second embodiment of the present invention, not shown in FIG. 2, is directed to an adhesive structure also in the form of a crown or cap in which a conventional protective paint layer 5 is applied to the outside surface of a crown or cap seal. That seal comprises a metal material such as aluminum, tin-plated steel sheet or tin-free steel, a first coating layer 2, containing vinyl resin and peeling imparter, applied to the inside surface of seal 1 and a printing ink layer 6, depicting a price marking, furnished on top of the first coating layer 2. Then, the second coating, layer 3, containing epoxy resin, is applied over the first coating layer 2 and printing ink layer 6. Packing 4, comprising, for example, a polyolefin or synthetic rubber, is furnished over this second coating layer 3. Packing 4 is supplied to the inside of the crown or cap in a molten or semimolten state and formed in the shape of the packing by compression under cooling with a suitable stamping element (not shown). Packing 4 will adhere to the second coating layer 3. Alternatively, packing 4 is a preformed disk, inserted inside the seal or cap and adhered to coating layer 3 by inductive heating.

In this crown or cap seal, first coating layer 2 is firmly joined to crown or cap shell 1 generally with a peeling strength of at least 2 kg/cm. Second coating layer 3 is firmly joined to packing 4 at a peeling strength of generally at least 0.2 kg/cm. First coating layer 2 and second coating layer 3 are adhered at a peeling strength of between about 0.05 and 5 kg/cm. Printing ink layer 6 has a stronger adhesive strength with respect to second coating layer 3 than to first coating layer 1. Thus, packing 4 together with printing ink layer 6 can be easily peeled from crown or cap shell 1 between first coating 2 and second coating 3.

Alternatively, printing ink layer 6 can be furnished by printing on second coating layer 3 in the crown in FIG. 2. Specifically, printing ink layer 6 can be located at the interface between packing 4 and second coating layer 3.

Figure 3:
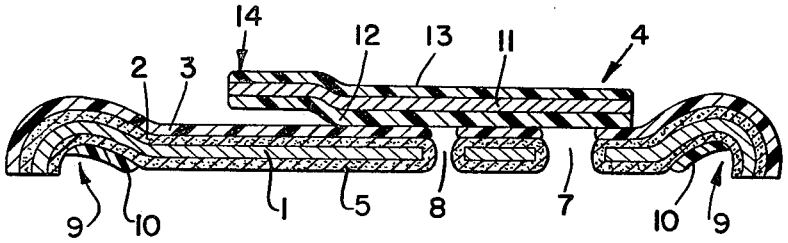
FIG. 3 is a cross-sectional view of a can cover with an easy-open mechanism of the present invention.

FIG. 3 shows a can cover where the adhesive structure includes a "pop-top" or easy-open mechanism. Can cover 1 comprises metal materials, such as aluminum, tin-plated steel sheet or tin-free steel, provided with opening 7 for pouring the contents of the can or beverage after unsealing opening 8 for inflow or air into the can. Channel 9 is provided around can cover 1 to contain the can body flange (not shown) and provides a two-layer wrapping. Conventional protective paint layer 5 is furnished on the inside surface of can cover 1. This protective paint layer also protects the metal materials from direct exposure at openings 7 and 8. Part of channel 9 contains a conventional sealant composition layer 10.

On the outside surface of can cover 1, first coating layer 2 containing vinyl resin and second coating layer 3 containing epoxy resin are successively applied. At least one of these coating layers contains the peeling imparter and saturated polyester wetting improver described above. Regarding the second embodiment, the first coating layer 2 preferably contains the peeling imparter described above.

Peeling piece 4, used to open the seal, is a second article comprising a laminate sheet that includes a polyolefin heat seal layer 12 on one side of a metal foil 11, such as aluminum, and heat-resistant resin layer 13, which can comprise polyethylene terephthalate, on the other side of foil 11. Peeling piece 4 includes handle 14 on one end. Heat seal layer of peeling piece 4 faces the surface on the outside layer of the can cover and is disposed to completely cover can cover openings 7 and 8, thereby permitting the can cover to be heat sealed.

Thus, by grasping handle 14 of peeling piece 4 and pulling it outward, the can cover may easily be opened by causing peeling between first coating layer 2 and second coating layer 3.

Figure 4:
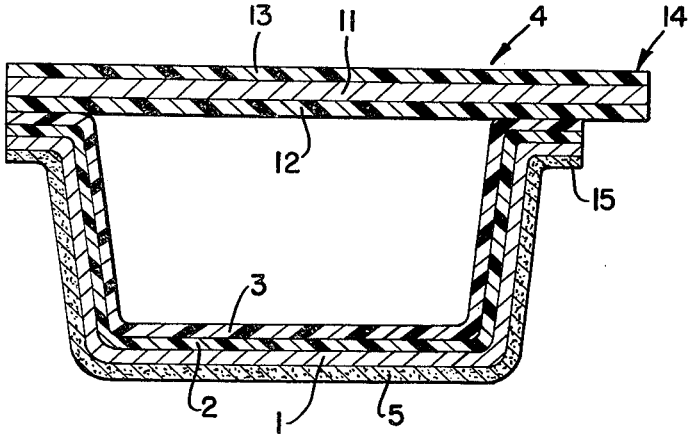
FIG. 4 is a cross-sectional view of a sealed container including the subject peelable structure.

FIG. 4 shows a sealed metal container with a first article or container 1 formed by drawing or stamping a metal material. Its inside surface is provided with first coating layer 2 and second coating layer 3. Its outside surface is provided with surface protective layer 5. The second article is cover element 4 comprising a laminate including layer 12, capable of being heat sealed on the surface of one side of metal foil 11, and a thermoplastic resin layer 13 on the other side of foil 11. Flange 15 is provided on the periphery of container 1. Cover element 4 is adhered to flange 15 by a heat seal. The container is opening by grasping handle 14 of cover element 4 and pulling it upward causing peeling at the interface between first coating 2 and second coating 3.

The adhesive structure of the present invention can be joined by melt adhesion of polyolefin on a metal base material that has been coated with paint. In order to enhance the adhesive strength of the polyolefin toward the second coating layer, it is preferred to have polyethylene oxide included in the second coating layer. The polyethylene oxide can have an oxygen content of between about 0.1 and 10 percent, more suitably between about 0.5 and 5.0 percent and an average molecular weight of about 1,000 to about 50,000, more suitably about 4,000 to about 10,000. The polyethylene oxide should be used in concentrations between about 0.5 and 90 weight percent, preferably between about 1 and 30 weight percent, of the epoxy resin.

Method of Making the Adhesive Structure

According to the present invention, the coating layers on the first article are formed by painting on that article, which can comprise a metal base material, vinyl resin or the resin with resin modifier, peeling imparter and saturated polyester wetting improver in the form of liquids dissolved in suitable solvents. Then, the painted base material is dried or heated, as required. Although there are no particular restrictions on the amount of paint applied, that is, the thickness of the first coating layer, suitable thickness ranges for solid fractions are about 0.5 to about 100 $mg/m^2$ and particularly 3 to 50 $mg/m^2$. Such thickness ranges will protect the base material and provide a suitable sealing.

The solvent used will vary depending on the ingredients contained in the first coating. Suitable solvents are ketones such as methyl ethyl ketone (MEK) and methyl isobutyl ketone (MIBK), cyclic ethers such as tetrahydrofurane (THF) and dioxane, alcohols such as various Cellosolves, isophorone, and diacetone alcohols, halogenated hydrocarbon solvents such as chloroform, alicyclic solvents such as cyclohexane, and aromatic solvents such as benzene, toluene, and xylene, used along or in combination. Although there are no particular restrictions on the concentration of solid fraction in the paint solution, 10 to 70 percent, particularly 2 to 50 percent, provided workable solutions.

Annealing conditions for the paint can be varied in different ways. Generally, annealing should be done at temperatures of 90° to 240° C. and for 10 to 30 minutes.

Regarding the second embodiment, the vinyl resin in the first coating layer and the epoxy resin in the second coating layer are present in the form of continuous phases. The hydrocarbon or natural resin of the peeling imparter, contained in these coating layers, is present in the form of a dispersed phase inside the continuous phases. This feature is very important for imparting suitable peelability between the first coating phase and the second coating phase while imparting the necessary wetting properties for painting between the two phases.

Specifically, when a peeling imparter, comprising hydrocarbon or natural resin, is present in the form of a continuous phase at the interface of the two coatings or in that vicinity, the adhesive strength between the two coatings becomes low. Also, there is excessive nonuniformity in the peeling strength. Consequently, adhesive structures of this type result in separation at the interface between the two coatings before the two are pulled apart and differences in peelability among individual product items.

When a peeling imparter, such as a hydrocarbon resin, is present in the form of a continuous phase, the wetting properties between the two coating layers become very poor. As shown in Japanese Patent Application 51-145196 it is difficult to distribute one paint on a layer of another in a uniform manner unless a special saturated polyester wetting improver is used.

In this regard, when hydrocarbon or natural resin is present as a peeling imparter in the form of a dispersed phase is either of at least one of the vinyl resin coating or the epoxy resin coating, it is possible to have a degree of adhesion between the two coating layers such that they will not peel under ordinary use and processing. Yet, they will readily peel when pulled apart. Thus, it becomes possible to significantly lower adhesive strength straggling to significantly improve wetting properties between the two coating layers and even if a special wetting improver is not used, to easily and uniformly distribute one coating layer on the other coating layer.

In this second embodiment, the dispersed phase of the hydrocarbon or natural resin has particles whose diameters will be less than about 100 microns, particularly less than about 20 microns and preferably less than about 5 microns. This is important to achieving a suitable combination of peelability and wettability properties. This importance will be readily understood by referring to the results in Table IX in Example IX.

For the hydrocarbon or natural resin to be present in the form of a dispersed phase in the coatings, it is important that those resins be present in a stable, finely dispersed state in the paint solution, and that this dispersed state be maintained until the coatings have been dried or hardened.

Specifically regarding the second embodiment, a first coating solution contains vinyl resin and hydrocarbon or natural resin having a softening point of less than about 180° C. in an amount between about 50 and 200 parts by weight per 100 parts by weight of the vinyl resin. The hydrocarbon or natural resin is stably dispersed by emulsifying in the continuous phase of the said vinyl resin. In dispersed form, the paint solution has the visual appearance of a stabilized white suspension. In order to obtain such paint solutions, suitable solvents must be selected relative to the type of resin used, and suitable dispersion means must be selected. The selection of these solvents will vary depending on the type of resin, and will be apparent to those skilled in the art having the benefit of the present disclosure before them.

When vinyl resin and hydrocarbon or natural resin are dissolved in a solvent (a) that dissolves both of them, for example, an aromatic solvent such as benzene, toluene or xylene, phase separation occurs with the vinyl resin at the bottom layer and the hydrocarbon or natural resin in the top layer. When a solvent (b), which readily dissolves the vinyl resin but does not readily dissolve the hydrocarbon resin and which is miscible with solvent (a), for example, a polar solvent such as ethyl acetate, tetrahydrofurane (THF) and methylisobutylketone (MIBK), is added with strong shearing agitation, the vinyl resin becomes a continuous phase, and a stable emulsion dispersed paint solution is formed with the hydrocarbon or natural resin present as fine particles. This solution in the dispersion state is particularly suitable regarding the second embodiment of the present invention.

When using paint solutions in this dispersed form, the concentration of the solid resin component is important, and should be in the range of between about 15 and 60 percent, preferably between about 25 and 50 percent. The weight ratio of solvent (a) to solvent (b) should be between about 70:30 and 30:70, and preferably between about 40:60 and 60:40. Within these ranges, the hydrocarbon and natural resin can be used in any proportions which will not separate as a precipitant (gel).

When paint solutions having the dispersed form described are used, coatings having the dispersed state stipulated by the present invention will be formed under ordinary annealing conditions for paint, that is, at 90° to 240° C. and for 10 to 30 minutes.

There are no particular restrictions regarding the thickness (paint application amount) of the first coating layer, but the range should be about 0.5 to about 100 mg/m$^2$, and preferably about 3 to about 50 mg/m$^2$, as solid fraction, to protect the metal base and to permit satisfactory sealing. The remaining description is identical for both of the embodiments.

Then, the epoxy resin and hardener which can include a peeling promoter, wetting improver and polyethylene oxide, are sprayed in the form of a paint solution dissolved or dispersed in a suitable solvent. That coating is then dried to make the second coating layer on top of the first coating layer. Although there are no particular restrictions on the amount of paint applied, that is, the thickness of the second coating layer, a range of solid fraction of about 0.5 to about 100 mg/m$^2$, preferably 3 to 50 mg/m$^2$, are suitable for adhesion of the second article to the coating layer. The solvent used can be selected from the organic solvents mentioned above. The concentration of solid fraction in the paint solution can also be selected from the ranges described above for the first coating.

When the second article, comprising preformed metal foil or sheet or plastic film or sheet, is adhered by means of the second coating layer, the second article is attached to the second coating layer when the epoxy resin is not hardened or is semi-hardened. Then, the assembly is heated as required, and adhesion is completed by hardening the second coating layer. Here, the heat curing conditions for the second coating layer will vary depending on the type of epoxy resin or hardener ingredient contained in the second coating layer and on the type of second article to be adhered. Suitable conditions can ordinarily be found within a temperature range of 10° to 250° C., particularly 80° to 200° C., and within a curing period of 5 to 60 minutes, particularly 15 to 30 minutes.

When adhering the second article onto the second coating layer by hot melt adhesion or heat seal, the second coating layer should be cured before the hot melt adhesion or heat seal process. Here, the heat curing conditions can be 80° to 200° C. and 15 to 30 minutes.

Although the first coating layer and then the second coating layer can be applied to the formed article in the present invention, the coating layers can be applied to the metal material before it is formed into the container or its cover. When this latter technique is used, several production advantages result because it permits better control over rusting of the metal material and because individual articles do not require coating. Moreover, because the first and second coatings of the present invention have superior processing characteristics, ordinary processing operations, such as punching, press forming, turning, draw forming, crimping and stamping, will not damage the coating or result in a loss of adhesion.

For applying resins such as polyolefins onto the second coating layer by hot melt adhesion or heat sealing, suitable temperatures are in the range of 120° to 300° C., preferably 150° to 230° C., depending on the type of olefin resin, and suitable melt adhesion periods are short, on the order of milliseconds.

The present invention and its advantages will be further illustrated and explained by the following examples.

EXAMPLE I

First, primer paints were prepared using vinyl resin modified as shown in Table I with varying amounts of phenol resin, urea resin or epoxy resin in vinyl chloride-vinyl acetate copolymer, with the petroleum resins being 150 parts by weight per 100 parts by weight of the modified vinyl resin solid fraction. Then, 10 parts by weight of thermoplastic saturated polyester were added and an equivalent mixed solution of methylisobutyl ketone and toluene was added to bring the total solid fraction concentration to 30 weight percent.

The first primer paints were applied on chemically treated steel sheet 0.27 mm thick that had previously been given surface degreasing treatment with Triclene (termed Tin Free Steel [TFS], Toyo Kohan [Toyo Kohan Kaisha, Ltd.] HAITOPPU). The painted sheet was heated at 190° C. for 10 minutes in an electric oven to form first primer layers of 50 mg/dm$^2$. Then, the following three types of paint were applied in amounts of 50 mg/dm$^2$ as second primers over the first primer layers: (1) epoxy-polyamine paint (xylene-methyl ethyl ketone, EPIKOTO #1004/EPOMETO B001=80/20, equivalent mixed solvent 30 weight percent solution), (2) epoxy-phenol paint (EPIKOTO #1007/PP-3005=80/20, xylene-butyl Cellosolve, equivalent mixed solvent 30 weight percent solution), and (3) epoxy-amino paint (EPIKOTO #1004/MERAN #11=80/20, xylene-butyl Cellosolve equivalent mixed solvent 30 weight percent solution), and after aluminum foil 0.05 mm thick had been pasted on top of the paint surfaces, heating was carried out at 190° C. for 15 minutes to make adhesive structures having aluminum foil-second primer layer-first primer layer-TFS.

The peeling strengths between the aluminum foil and the TFS sheet were measured using tension tests for each of the various types of adhesive structures produced. Measuring conditions for the tension tests were 180° peeling, pulling speed of 50 mm/min, at 20° C.

The results are tabulated in Table I.

TABLE I

| | First Primer Compositions* | | | | | | Peeling Strength kg/cm Second Primers | | |
|---|---|---|---|---|---|---|---|---|---|
| No. | VC/V Ac | Ph | U | Ep | R | W | Ep/Ph | E/U | E/A |
| 1 | 50 | 50 | — | — | 150 | 10 | 0.62 | 0.50 | 0.72 |
| 2 | 80 | 20 | — | — | " | " | 0.58 | 0.52 | 0.56 |
| 3 | 90 | 10 | — | — | " | " | 0.48 | 0.44 | 0.52 |
| 4 | 80 | — | 20 | — | " | " | 0.52 | 0.52 | 0.66 |
| 5 | 80 | — | — | 20 | " | " | 0.50 | 0.48 | 0.58 |
| 6 | 80 | 10 | 10 | — | " | " | 0.54 | 0.56 | 0.65 |
| 7 | 80 | — | 10 | 10 | " | " | 0.52 | 0.52 | 0.65 |

TABLE I-continued

| | First Primer Compositions* | | | | | | Peeling Strength kg/cm Second Primers | | |
|---|---|---|---|---|---|---|---|---|---|
| No. | VC/V Ac | Ph | U | Ep | R | W | Ep/Ph | E/U | E/A |
| 8 | 70 | 10 | 10 | 10 | " | " | 0.46 | 0.52 | 0.50 |

*Numbers are solid fractions in parts by weight
VC/V Ac: vinyl chloride-vinyl acetate copolymer, ESUREKKU C, Sekisui Kagaku [Sekisui Chemical Co., Ltd.]
Ph: resol type phenol, HITANORU #2080, Hitachi Kasei [Hitachi Chemical]
U: butylated urea, MERAN #11, Hitachi Kasei
Ep: Epoxy, EPIKOTO #1004, Shieru [Shell]
R: peeling impater, ESUKORETTSU petroleum resin, Esso
W: polyester rein, PAIRON #300, Toyo Boseki [Toyo Spinning Co., Ltd.]
A: polyamine, EPOMETO B-001, Ajinomoto [Ajinomoto Co., Inc.]

Peeling at the interface between the first primer layer and the second primer layer was determined in each sample by observation with a stereomicroscope.

There was minimal variation in peeling strength resulting from additional amounts or types of modified resins in the first primer. Regarding film properties, processability, particularly turning processability, became worse, and cracking occurred when the concentration of modified resin exceeded 50 parts based on the vinyl resin.

EXAMPLE II

Phenol modified vinyl resin (30 weight percent toluene, methyl isobutyl ketone solvent), modified by adding resol to vinyl chloride-vinyl acetate copolymer (VMCH made by Union Carbide) in solid fraction proportions of 70:30, was combined with various hydrocarbon resins in varying amounts. Polyester resin was added in proportions of 10 parts per 100 parts of vinyl resin, and methyl ethyl ketone, toluene and butyl Cellosolve equivalent solvents were added to make a first primer paint whose total solid fraction concentration was 30 weight percent.

The primer was applied to tin plate 0.3 mm thick whose surface had been degreased. The painted plate was heated at 190° C. for 10 minutes to form a first primer layer with a paint film of 100 mg/dm$^2$. Next, the epoxy-phenol resin paints used as the second primer in Example I were applied on the first primer layer. Then, a 0.05 mm aluminum foil, as in Example I, was pasted thereon. The structure was cured by heating at 190° C. for 10 minutes. An adhesive structure having aluminum foil-second primer-first primer-tin plate was produced.

Table II gives peeling strength measurements between the metals of each adhesive structure using the same conditions as in Example I.

TABLE II

| | First Primer Composition | | | | | | | Peeling |
|---|---|---|---|---|---|---|---|---|
| Sample No. | Modified Vinyl | Petroleum Resin | Natural Rosin | Rosin Ester | Cumarone Resin | Terpene Resin | Polyester Resin | Strength kg/cm |
| 1 | 100 | 0 | — | — | — | — | 0 | No Peeling* |
| 2 | " | 20 | — | — | — | — | 10 | 2.37 |
| 3 | " | 100 | — | — | — | — | " | 1.14 |
| 4 | " | 200 | — | — | — | — | " | 0.58 |
| 5 | " | 300 | — | — | — | — | " | 0.02 |
| 6 | " | — | 100 | — | — | — | " | 0.96 |
| 7 | " | — | — | 100 | — | — | " | 1.10 |
| 8 | " | — | — | — | 100 | — | " | 0.88 |

TABLE II-continued

| Sample No. | First Primer Composition: Modified Vinyl | Petroleum Resin | Natural Rosin | Rosin Ester | Cumarone Resin | Terpene Resin | Polyester Resin | Peeling Strength kg/cm |
|---|---|---|---|---|---|---|---|---|
| 9 | " | — | — | — | — | 100 | " | 1.20 |

*Aluminum foil cut
Modified vinyl: vinyl chloride-vinyl acetate copolymer/resol type phenol = 70/30 blended
Petroleum resin: ESUKORETTSU
Rosin ester:
Cumarone resin: Nittetsu Kagaku [Nittetsu Chemical]
Terpene resin: YS Resin
Polyester resin: Vitel PE-207

Peeling strength declined as the concentration of hydrocarbon resin increased. Addition of 300 parts of hydrocarbon resin failed to give a substantially effective adhesive structure because peeling occurred between the tin plate and aluminum foil from a simple impact. However, below 20 parts of resin, the adhesive strength was too strong, and the peelable adhesive structure, characteristic of the present invention, was not achieved. When saturated polyester was not added and if the concentration of hydrocarbon resin exceeded 300 parts, wetting of the second primer became exceedingly poor, and the coated sheet showed a marked deterioration.

EXAMPLE III

The No. 2 blend used in Example II (150 parts of petroleum resin per 100 parts of phenol modified vinyl, with 10 parts of saturated polyester added, was applied on TFS sheet as the first primer. That was heat cured at 190° C. for 10 minutes. Epoxy-phenol resin, used in Example II, was applied as the second primer. Surface treated 0.2 mm thick polyethylene sheet (PE), polypropylene sheet (PP) and hardened vinyl chloride sheet (PVC), and paper (P) were each pasted over the primers. Heat curing was done at 130° C. for the paper and at 90° C. for the other materials to make four types of adhesive structures: PE-primer-TFS, PP-primer-TFS, PVC-primer-TFS and paper-primer-TFS.

Table III shows the results of measurements of the peeling strengths of each structure.

TABLE III

| No. | Construction | Peeling Strength |
|---|---|---|
| 1 | PE-primer-TFS | 0.66 |
| 2 | PP-primer-TFS | 0.52 |
| 3 | PVC-primer-TFS | 0.30 |
| 4 | Paper-primer-TFS | 0.95 |

In all cases, peeling occurred between the primers in their two layers, notwithstanding differences in the types of construction materials.

EXAMPLE IV

First and second primer solutions in the blends shown in Table IV were applied to a tin plate 0.3 mm thick that had been given degreasing treatment. Adhesive structures having aluminum foil-first primer layer-second primer layer-tin plate were made by the same process as in Example I. The same peeling tests as in Example I were performed on each sample. The results are tabulated in Table IV.

TABLE IV

| No. | First Primer Composition | | Second Primer Composition | | Peeling Strength kg/cm |
|---|---|---|---|---|---|
| 1 | VC/V Ac*1 | 100 | Ep/Ph*2 | 100 | |

TABLE IV-continued

| No. | First Primer Composition | | Second Primer Composition | | Peeling Strength kg/cm |
|---|---|---|---|---|---|
| | | | R*3 | 100 | 0.76 |
| | | | W*4 | 10 | |
| 2 | VC/V Ac | 100 | Ep/Ph | 100 | |
| | R | 80 | R | 20 | 0.58 |
| | W | 8 | W | 2 | |
| 3 | VC/V Ac | 100 | Ep/Ph | 100 | |
| | R | 100 | W | 10 | 0.66 |

*1, *2, *3, *4: The VC/V Ac, Ep/Ph, R and W were the same materials used in Example I All blends peeled at suitable strengths regardless of whether the petroleum resin and polyester resin were included in the first primer layer and/or the second primer layer.

EXAMPLE V

No. 1 to No. 9 of the first primers used in Example II were applied to TFS sheet and heat cured. Then, polyethylene oxide dissolved in hot xylene (concentration 1.0, softening point 135° C, total oxygen concentration 4.3 percent) was added to the epoxy-phenol resin used in Example II up to an amount equal to 10 weight percent of the entire resin. It was dispersed to make a product where the solid fraction concentration of the entire paint was 30 weight percent. This was applied on the first primer as the second primer and heat cured at 190° C. for 15 minutes. Then, commercial alkyd ink was printed on the second primer layer of the metal coated sheets, having the two primer layers, by a conventional offset printing method. It was dried to make printed coated metal sheet of the construction called ink-primer-TFS.

Then, the coated sheet was stamped out using conventional technology, to make crown shells having printed surfaces on their inner sides.

Then, the low density polyethylene, used in Example III, was passed through a conventional extruder ($\phi$ 20 mm, L/D 10). The molten polyethylene flowed at about 1 g per crown over the insides of the crowns. They were punched with a metal plate to apply polyethylene liners to the crown shells. After cooling, the liners were peeled from the crown shells. Stamping, turning and other process characteristics required for stamping out crowns and corrosion resistance to outdoor exposure were evaluated. The results are compiled in Table V.

TABLE V

| Sample No. | Peelability | Processability | Corrision Resistance |
|---|---|---|---|
| 1 | X* | O | O |
| 2 Δ | O | O | |
| 3 | O | O | O |
| 4 | O | O | O |
| 5 | O | X | X |
| 6 | O | O | O |

TABLE V-continued

| Sample No. | Peelability | Processability | Corrision Resistance |
|---|---|---|---|
| 7 | O | O | O |
| 8 | O | O | O |
| 9 | O | O | O |

*Liner unpeelable

When the concentration of petroleum resin was less than 20 parts by weight, the adhesive strength between the first primer layer and the second primer layer was strong. As a result, the polyethylene liner could not be peeled. However, when the concentration exceeded 200 parts by weight, small pieces of film (dust) were formed during crown manufacture. Because liner adhesive strength was low, the polyethylene liners fell off during transport of the crown, making them impractical. All the other blends had suitable peeling strengths. Their processability and corrosion resistance were good, and the blends had sufficient capacity for crown sealing. Also, the second primer layers and the printed articles were transferred to the polyethylene liner after peeling.

EXAMPLE VI

First primer paints were prepared with vinyl resin modified as shown in Table VI with phenol resin, urea resin or epoxy resin in vinyl chloride-vinyl acetate copolymer, with the petroleum resins being 150 parts by weight per 100 parts by weight of the modified vinyl resin solid fraction. Then, a xylene/methylisobutyl ketone mixed solvent in a ratio of 40:30 was added. The mixture was agitated and heated (60° C., 2000 rpm, 15 minutes) to bring the total solid fraction concentration to 30 weight percent.

The first primer paints were applied in the manner described in Example I, however, the thickness of the aluminum foil was 0.01 mm.

Peeling strengths were measured in the manner and under the conditions described in Example I. Peeling at the interface between the first and second primer layers was observed with a stereomicroscope. The results are tabulated in Table VI.

TABLE VI

| | First Primer Compositions* | | | | | Peeling Strength kg/cm Second Primers | | |
|---|---|---|---|---|---|---|---|---|
| No. | VC/V Ac | Ph | U | Ep | R | Ep/Ph | E/U | E/A |
| 1 | 50 | 50 | — | — | 150 | 0.67 | 0.50 | 0.78 |
| 2 | 80 | 20 | — | — | " | 0.62 | 0.57 | 0.61 |
| 3 | 90 | 10 | — | — | " | 0.45 | 0.44 | 0.55 |
| 4 | 80 | — | 20 | — | " | 0.52 | 0.52 | 0.66 |

TABLE VI-continued

| | First Primer Compositions* | | | | | Peeling Strength kg/cm Second Primers | | |
|---|---|---|---|---|---|---|---|---|
| No. | VC/V Ac | Ph | U | Ep | R | Ep/Ph | E/U | E/A |
| 5 | 80 | — | — | 20 | " | 0.50 | 0.48 | 0.60 |
| 6 | 80 | 10 | 10 | — | " | 0.53 | 0.59 | 0.65 |
| 7 | 80 | — | 10 | 10 | " | 0.52 | 0.52 | 0.69 |
| 8 | 70 | 10 | 10 | 10 | " | 0.44 | 0.55 | 0.50 |

*Numbers are solid fractions in parts by weight
VC/V Ac: vinyl chloride-vinyl acetate copolymer, ESUREKKU C, Sekisui Kagaku [Sekisui Chemical Co., Ltd.]
Ph: resol type phenol, HITANORU #2080, Hitachi Kasei [Hitachi Chemical]
U: butylated urea, MERAN #11, Hitachi Kasei
Ep: Epoxy, EPIKOTO #1004, Sheru [Shell]
R: peeling imparter, ESUKORETTSU petroleum resin, Esso
A: Polyamine, EPOMETO B-001, Ajinomoto [Ajinomoto Co., Inc.]

The results were the same as those described in Example I.

EXAMPLE VII

Phenol modified vinyl resin (30 weight percent toluene, methyl isobutyl ketone solvent) modified by adding resol to vinyl chloride-vinyl acetate copolymer (VMCC made by Union Carbide) in solid fraction proportions of 70:30 was combined with various hydrocarbon resins in varying amounts. Solvents, such as toluene THF, were added. This mixture was agitated in the manner described in Example VI to obtain a first primer paint with a total solid fraction concentration of 30 weight percent.

The primer was applied in the manner described in Example II, however, the thickness of the aluminum foil was 0.01 mm. Peeling strength between the metals of each adhesive structure were measured in the same manner and under the same conditions as in Example I. The results are tabulated in Table VII.

TABLE VII

| | First Primer Composition | | | | | | Peeling |
|---|---|---|---|---|---|---|---|
| Sample No. | Modified Vinyl | Petroleum Resin | Natural Rosin | Rosin Ester | Cumarone Resin | Terpene Resin | Strength kg/cm |
| 1 | 100 | 0 | — | — | — | — | No Peeling* |
| 2 | " | 20 | — | — | — | — | 3.23 |
| 3 | " | 100 | — | — | — | — | 1.18 |
| 4 | " | 200 | — | — | — | — | 0.60 |
| 5 | " | 300 | — | — | — | — | 0.02 |
| 6 | " | — | 100 | — | — | — | 0.93 |
| 7 | " | — | — | 100 | — | — | 1.14 |
| 8 | " | — | — | — | 100 | — | 0.86 |
| 9 | " | — | — | — | — | 100 | 1.22 |

*Aluminum foil cut
Modified vinyl: vinyl chloride-vinyl acetate copolymer/resol type phenol = 70/30 blended
Petroleum ester: ESUKORETTSU
Cumarone resin: Nittetsu Kagaku [Nittetsu Chemical]
Terpene resin: YS resin Peeling strength declined as the concentration of hydrocarbon resin increased. Addition of 300 parts of hydrocarbon failed to give a substantially effective adhesive structure, because peeling occurred between the tin plate and aluminum foil from a simple impact. However, below 20 parts of resin, the adhesive strength was too strong, and the peelable adhesive structure, characteristic of the present invention, was not achieved.

EXAMPLE VIII

The No. 2 blend used in Example I (150 parts of petroleum resin per 100 parts of phenol modified vinyl) was applied on TFS sheet as the first primer. After heat curing (190° C., 10 minutes), the epoxyphenol resin used in Example II was applied as the second primer. Surface treated 0.22 mm thick polyethylene sheet (PE), polypropylene sheet (PP) and hardened vinyl chloride sheet (PVC), and paper (P) were each pasted over the primers. Heat curing was done at 130° C. for the paper and at 90° C. for the other materials to make four types of adhesive structures: PE-primer-TFS, PP-primer-TFS, PVC-primer-TFS and paper-primer-TFS.

Table VII shows the results of measurements of the peeling strengths of each structure.

TABLE VIII

| No. | Construction | Peeling Strength |
|---|---|---|
| 1 | PE-primer-TFS | 0.73 |
| 2 | PP-primer-TFS | 0.54 |
| 3 | PVC-primer-TFS | 0.37 |
| 4 | Paper-primer-TFS | 1.01 |

In all cases, peeling occurred between the primers in their two layers, notwithstanding differences in the types of construction materials.

EXAMPLE IX

Petroleum resin was added to the modified vinyl resin used in Example VI at 150 parts by weight per 100 parts by weight of vinyl resin. Solvent mixtures of SORUBESSO #100, xylene and ethyl acetate were used with the mixture ratios varied as shown in Table IX. The total solid fraction concentration was set at 30 weight percent to make the first primer paints. The vinyl resin, petroleum resin and mixed solvent were agitated and heated to 60° C., using a high speed homogenizer at 3000 rpm for 10 minutes. The resulting primers were inspected using a suitable measurement apparatus. After measuring the dispersed particle sizes of the petroleum resin in the primers, they were applied onto tin plate by the same operations as in Example II. The primers were then cured. Second primers were applied in the same manner described in Example II, and aluminum foil was attached to make the construction aluminum foil-second primer-first-primer-tin plate.

Peeling strength between metals was measured under the same conditions as in Example I for these constructions. The results are tabulated in Table IX. Also, the degree of variation in peeling strengths was shown using a variation coefficient.

TABLE IX

| No. | Solvent Composition SOURBESSO #100 | Xylene | Ethyl acetate | Particle Diameter* (microns) | Coating Condition | Peeling Strength (kg/cm) | Variation Coefficient % |
|---|---|---|---|---|---|---|---|
| 1 | 80 | 20 | 0 | Layer Separation | 2nd Primer Rejected | 0.08 | 70 |
| 2 | 40 | 40 | 20 | 150 | Orange Peel Surface | 0.33 | 40 |
| 3 | 20 | 40 | 40 | 3 | Excellent | 1.54 | 10 |
| 4 | 10 | 30 | 60 | 6 | " | 1.04 | 10 |
| 5 | 0 | 20 | 80 | Layer Separation | Orange Peel Surface | 0.12 | 50 |
| 6 | 0 | 0 | 100 | Precipitation | — | — | — |

*Particle diameter measured after letting stand for one hour following agitation When the concentration of the solvents was varied, the dispersed particle diameters of the petroleum resin in the solutions varied. As a result, there were marked variations in wetting of the second primer, and variations in the peeling strengths between the metals.

When the concentration of ethyl acetate in the solvent mixture was small, the dispersion solution separated into layers within a short time after agitation. When the concentration was large, precipitation occurred from the petroleum resin system, and painting was impossible.

EXAMPLE X

After forming a base coat layer (epoxyamino paint), printing, and an overcoat layer (epoxyester paint) on one side of a TFS surface, which surface comprises the other surfaces of crowns, the other surfaces was painted with first primers No. 1 to No. 9 used in Example VII. They were heat cured. Then, a commercial alkyd ink was printed and dried on the first primer layer using a conventional offset printing method. Polyethylene oxide dissolved in hot xylene (concentration 1.0, softening point 135° C., total oxygen concentration 4.3 percent) was added to the epoxy-urea resin used in Example VII until it amounted to 20 weight percent of the total resin. It was dispersed, and the product, whose solid fraction concentration in the total paint was 30 weight percent, was painted as a second primer over these partially printed first primer layers. Heat curing was done at 190° C. for 15 minutes. Thus, the metal sheet was coated on both sides and printed.

Next, crown shells were formed from the coated sheet with a crown forming press. The size of the shells was that of a Type 5 Crown size (inner diameter 26.6 mm) in JIS S-9017.

Then, the low density polyethylene used in Example VIII was passed through a conventional extruder ($\phi$ 20, mm, L/D 10. The extruded molten polyethylene flowed onto the insides of the crowns at about 1 g per crown, and was formed into polyethylene liners in the crown shells by punching with a metal plate.

Then, the liners were peeled from the crown shells. They were evaluated with respect to their processability during punching and turning required for crown shells and with respect to their corrosion resistance under outdoor exposure. The liners were also evaluated for dust generation using a tumbling test (500 crown shells were placed into a stainless cylindrical vessel (30 cm inner diameter, 50 cm high), given 2100 revolutions at 70 rpm). Weight differences were measured before and after the test to find the amount of dust generated by coating separation. The results are shown in Table X.

TABLE X

| Sample No. | Peelability | Processability | Corrosion Resistance | Dust Formation (mg) |
|---|---|---|---|---|
| 1 | X* | O | O | 3 |
| 2 | Δ | O | O | 11 |
| 3 | O | O | O | 17 |
| 4 | O | O | O | 28 |
| 5 | X | X | X | 122 |
| 6 | O | O | O | 21 |

TABLE X-continued

| Sample No. | Peelability | Processability | Corrosion Resistance | Dust Formation (mg) |
|---|---|---|---|---|
| 7 | O | O | O | 19 |
| 8 | O | O | O | 23 |
| 9 | O | O | O | 30 |

*Liner unpeelable

When the concentration of petroleum resin was less than 20 parts by weight, the adhesive strength between the first primer layer and the second primer layer was strong. As a result, the polyethylene liner was impossible to peel. On the other hand, when the concentration of the resin exceeded 200 parts by weight, there was a large formation of small pieces of film (dust), and because liner adhesive strength was low, the polyethylene liners fell off during crown transport rendering them impractical. All the other blends had suitable peeling strengths. Their processability and corrosion resistance were good, and they were found to have sufficient capacity as crowns for sealing. Also, the second primer layers and the printed parts transferred to the polyethylene liner after peeling.

It is not intended to limit the present invention to the specific embodiments described above. Other changes may be made in the peelable adhesive structure specifically described without departing from the scope and teachings of the present invention. The invention is intended to encompass all other embodiments, alternatives and modifications consistent with it.

We claim:

1. A peelable adhesive structure comprising a plurality of articles, including at least one metal article, bonded together through a composite coating layer, the composite coating layer comprising adjacent first and second coating layers, the first coating layer containing vinyl resin and having a thickness ranging from about 0.5 to about 100 mg/m$^2$, the second coating layer containing epoxy resin without vinyl resin and having a thickness ranging from about 0.5 to about 100 mg/m$^2$ at least one of the coating layers comprising:

(a) a peeling imparter at a concentration of between about 50 and 200 parts by weight per 100 parts by weight of resin, and (b) a substantially linear saturated polyester wetting improver at a concentration of between about 2 and 50 parts by weight per 100 parts by weight of resin and having a molecular weight of between about 5,000 and about 50,000, the plurality of articles having a peeling strength between about 0.05 and 5 kg/cm between the first and the second coating layers.

2. A bonded structure according to claim 1 wherein the peeling imparter is a natural resin or a hydrocarbon resin having a softening point up to about 180° C.

3. A bonded structure according to claim 2 wherein the hydrocarbon resin is a petroleum resin or cumarone-indene resin.

4. A bonded structure according to claim 2 wherein the natural resin is rosin, rosin ester or terpene resin.

5. A bonded structure according to claim 1 wherein the saturated polyester wetting improver is a substantially linear saturated copolyester made from dibasic acid and diol ingredients, at least one of said ingredients including more than one type of compound.

6. A bonded structure according to claim 1 wherein the saturated polyester wetting improver is a copolyester made using terephthalic acid (T) and isophthalic acid (I) as the dibasic acid ingredient and ethylene glycol (E) and 1,4-butanediol (B) as the diol ingredient.

7. A bonded structure according to claim 6 wherein the mole ratio of the T:I is between about 90:10 and 10:90 and that of the E:B is between about 70:30 and 30:70.

8. A bonded structure according to claim 6 or 7 wherein an aliphatic dibasic acid having between about 6 and 14 carbon atoms comprises the dibasic acid ingredient at between about 1 and 100 mole percent of the total weight of the terephthalic acid and isophthalic acid.

9. A bonded structure according to claim 1 wherein the vinyl resin is a copolymer of (a) vinyl chloride and (b) a vinyl monomer other than vinyl chloride.

10. A bonded structure according to claim 1 or 9 wherein the first coating layer comprises a composition containing vinyl resin (A) and at least one type of resin modifier (B) selected from a phenol resin, amino resin or epoxy resin, and the weight ratio of A:B is between about 60:40 and 98:2.

11. A bonded structure according to claim 1 wherein the second coating layer comprises a composition containing an epoxy resin ingredient (C) and a resin (D) selected from a resol type phenol formaldehyde resin, urea-formaldehyde resin or melamine-formaldehyde resin, and the weight ratio of C:D is between about 5:95 and 95:5.

12. A bonded structure according to claim 1 wherein the peeling imparter or the saturated polyester wetting improver and the peeling imparter in combination comprise the first coating layer.

13. A bonded structure according to claim 1 wherein the first coating layer and the second coating layer have a peeling strength between about 0.4 and 1.5 kg/cm.

14. A bonded structure according to claim 1 wherein one of the plurality of articles comprises a metal material, the other article comprises an olefin resin layer, the second coating layer comprises polyethylene oxide, whose oxygen content is between about 0.1 and 10 percent by weight and whose mean molecular weight is in the range of about 1,000 to about 50,000 in an amount between about 0.5 and 90 percent by weight of the epoxy resin, and the other article is joined to the second coating layer by melt adhesion or heat sealing of olefin resin.

15. A bonded structure according to claim 1 wherein the article comprising the metal material is a crown, and the other article is packing formed from olefin resin.

16. A peelable adhesive structure comprising a plurality of articles, including at least one metal article, bonded together through a composite coating layer, the composite coating layer comprising adjacent first and second coating layers, the first coating layer containing vinyl resin and having a thickness ranging from about 0.5 to about 100 mg/m$^2$, the second coating layer containing epoxy resin without vinyl resin and having a thickness ranging from about 0.5 to about 100 mg/m$^2$, at least one of the coating layers comprising:

a hydrocarbon or natural resin having a softening point less than 180° C. and having a concentration between about 50 and 200 parts by weight per 100 parts by weight of resin, the vinyl resin or the epoxy resin being in the form of a continuous phase, the hydrocarbon or natural resin being in the form of a dispersed phase whose particles are less than 100 microns in diameter, and the plurality of articles having a peeling strength between about 0.05 and 5 kg/cm between the first and second coating layers.

17. A bonded structure according to claim 16 wherein the hydrocarbon resin is selected from a petroleum resin or a cumarone-indene resin.

18. A bonded structure according to claim 16 wherein the natural resin is selected from a rosin, a rosin ester or a terpene resin.

19. A bonded structure according to claim 16 wherein the vinyl resin is a copolymer of (a) vinyl chloride and (b) an ethylene unsaturated monomer other than vinyl chloride.

20. A bonded structure according to claim 19 wherein the first coating layer comprises a composition containing vinyl resin (A) and at least one resin modifier (B) selected from a phenol resin, an amino resin or an epoxy resin, present in weight ratios of (A):(B) between about 60:40 and 98:2.

21. A bonded structure according to claim 16 and wherein the second coating layer comprises a composition containing an epoxy resin ingredient (C) and resin (D) selected from a resol type phenol formaldehyde resin, a urea-formaldehyde resin or a melamine-formaldehyde resin, present in the weight ratio of (C):(D) between about 5:95 and 95:5.

22. A bonded structure according to claim 16 wherein the hydrocarbon or natural resin is contained in the first coating layer.

23. A bonded structure according to claim 16 having a peeling strength of between about 0.4 and 1.5 kg/cm between the first coating layer and the second coating layer.

24. A bonded structure according to claim 16 wherein one of the said plurality of articles comprises a metal material, the other article comprises an olefin resin layer, the second layer contains polyethylene oxide, whose oxygen content is between about 0.1 and 10 percent by weight and whose mean molecular weight is in the range of about 1,000 to about 50,000 in amounts between about 0.5 and 90 percent by weight of the epoxy resin, and the other article is joined to the second coating layer by metal adhesion or heat sealing of olefin resin.

25. A bonded structure according to claim 16 wherein the article comprising the metal material is a crown shell and the other part is packing formed from olefin resin.

* * * * *

UNITED STATES PATENT AND TRADEMARK OFFICE

CERTIFICATE OF CORRECTION

PATENT NO. : U.S. 4,270,665

DATED : June 2, 1981

INVENTOR(S) : GO KUNIMOTO ET AL.

It is certified that error appears in the above—identified patent and that said Letters Patent is hereby corrected as shown below:

Column 5, line 56, "by" should be -- be --.

Column 6, line 9, "cumaroneindene" should be -- cumarone-indene --.

Column 18, line 65, "2Δ O O" should be -- 2 Δ O O --.

Column 21, line 7, "Table VII" should be -- Table VIII".

Column 22, line 8, "other (first occurrence) should be -- outer --.

Signed and Sealed this

Fourth Day of August 1981

[SEAL]

Attest:

GERALD J. MOSSINGHOFF

Attesting Officer

Commissioner of Patents and Trademarks